United States Patent [19]

Backlund et al.

[11] Patent Number: 4,922,989

[45] Date of Patent: May 8, 1990

[54] TREATMENT OF MECHANICAL PULP TO REMOVE RESIN

[75] Inventors: Ake Backlund; Olof Ferritsius; Goran Tistad, all of Karlstad, Sweden

[73] Assignee: Kamyr AB, Karlstad, Sweden

[21] Appl. No.: 787,140

[22] Filed: Oct. 15, 1985

[30] Foreign Application Priority Data

Oct. 15, 1984 [SE] Sweden ..... 8405128

[51] Int. Cl.[5] ..... D21B 1/04

[52] U.S. Cl. ..... 162/24; 162/26; 162/28; 162/37; 162/40; 162/52; 162/55; 162/56; 162/57; 162/71; 162/78; 162/83; 162/84

[58] Field of Search ..... 162/52, 57, 55, 24, 162/26, 25, 28, 71, 100, DIG. 4, 17, 18, 19, 37, 40, 56, 78, 83, 84

[56] References Cited

U.S. PATENT DOCUMENTS

| | | | |
|---|---|---|---|
| 2,862,784 | 12/1958 | Kise et al. | 162/78 |
| 3,627,629 | 12/1971 | Miller | 162/17 |
| 4,339,206 | 7/1982 | Ahs | 162/57 X |
| 4,444,621 | 4/1984 | Lindahl | 162/56 X |
| 4,504,016 | 3/1985 | Wikdahl | 162/55 |
| 4,596,631 | 6/1986 | Trough et al. | 162/55 X |

FOREIGN PATENT DOCUMENTS 116765 7/1946 Sweden .

418628 9/1979 Sweden .

OTHER PUBLICATIONS

Pulp and Paper Manufacture: Vol. I-The Pulping of Wood, Second Ed., McGraw-Hill Book Co., 1969, pp. 726-727.

*Primary Examiner*—Peter Chin
*Assistant Examiner*—Thi Dang
*Attorney, Agent, or Firm*—Nixon & Vanderhye

[57] ABSTRACT

Resin is removed from mechanical pulps, such as TMP, CTMP, and the like, in a quick and simple manner. Mechanical pulp at a consistency of about 7-20 percent (preferably 8-15 percent) is subjected to high turbulence. The high turbulence may be effected by fluidizing the pulp, as in a centrifugal fluidizing pump, or otherwise by subjecting it to high turbulence as in a mixer, screen, or disc mill refiner. By subjecting the pulp to high turbulence treatment for a time period of about 0.2-10 seconds, resin removal is greatly enhanced, and in subsequent dewatering of the pulp a pressate is formed which has a higher concentration of resin in the pressate than in pressates produced by conventional processes. After dewatering the pulp is preferably diluted (again to about 7-20 percent consistency), and the turbulence and dewatering steps are repeated. Chemicals to improve deresination can be added to the pulp while it is subjected to high turbulence.

19 Claims, 3 Drawing Sheets

TREATMENT OF MECHANICAL PULP TO REMOVE RESIN

BACKGROUND AND SUMMARY OF THE INVENTION

In the production of mechanical pulps from vegetable raw material, such as wood chips, for many end uses it is necessary to effect removal of resin from the pulp. The raw material itself contains resin, and there is no opportunity for removal of the resin by chemicals such as in the production of kraft pulp. Resin is an undesirable component of the final pulp, and constitutes a complex mixture of components that are present in the wood chips, or like raw material, enclosed in ray cells, parenchyma cells, and resin ducts. Among the components of resin are steroids, waxes, glycerides, resin acids, terpenes, and fatty acids.

When resin is present in mechanical pulp, it gives a smell and taste to food packed in cardboard made from the pulp (especially cardboard for containing liquids), and since the resin is of a hydrophobic nature and makes the cellulosic material fibers of the pulp hydrophobic, the pulp is undesirable for uses such as tissue pulp and fluffed pulp where good liquid absorbency properties are necessary.

In the conventional method of removing resin from mechanical pulps, the pulp is diluted from the refiner consistency (e.g. about 25–45 percent) to a concentration of about 3–5 percent. After dilution the pulp is stored for about 15–30 minutes in a tank at 50°–80° C. Thereafter the pulp is pumped to a press where it is pressed to a dryness of about 30 percent. The pressate, which contains resin therein, is separated from the pulp. The pulp is again diluted and again held in another tank for about 15–30 minutes, and is again pressed. The number of dilution and pressing stages are chosen so that the desired removal of resin from the pulp can be achieved.

According to the present invention, a simplified method of resin removal is provided. According to the present invention, resin removal is accomplished along with a significant reduction of the relatively long time which is required when conventional methods are utilized. Also, according to the present invention the amount of equipment necessary to effect dilution or the like is reduced, and the energy necessary for removal can be reduced, since resin removal can be effected at a much higher consistency than in conventional procedures (e.g. at 7–20 percent, compared to 3–5 percent in conventional procedures). Also, the pressate has a significantly higher concentration of resin therein, from which additional advantages flow; and, latent properties of the pulp can inherently and simultaneously be removed.

According to the present invention a method of effecting resin removal from mechanical pulp is provided. The method comprises the steps of: (a) feeding a mechanical pulp having a consistency of about 7–20 percent to at least one high turbulent stage; (b) at the high turbulent stage, exposing the mechanical pulp at about 7–20 percent consistency to a high degree of turbulence; and (c) after step (b), dewatering the mechanical pulp to produce a pressate containing resin removed from the pulp. Typically, the time necessary to subject the pulp to the high turbulence to effect resin removal is from about 0.2–60 seconds, and usually within about 0.2–10 seconds. After dewatering the pulp can be diluted, and then the steps repeated as necessary until complete resin removal is effected. During the practice of step (b), temperature conditions of about 50°–150° C. (preferably about 70°–120° C.) are maintained, and the pulp concentration is preferably about 8–15 percent. Further, in order to enhance deresination, chemicals that improve deresination can be added during the high turbulence step.

The equipment necessary to subject the mechanical pulp to sufficiently high turbulence may comprise a fluidizing pump, and/or a screen, and/or a disc refiner, and/or a mixer, and/or a distinct turbulence generator that is disposed at the inlet of a centrifugal pump.

It is the primary object of the present invention to effect resin removal from mechanical pulps in a simple, quick, and efficient manner. This and other objects of the invention will become clear from an inspection of the detailed description of the invention, and from the appended claims.

DETAILED DESCRIPTION OF THE DRAWINGS

Figure 1:
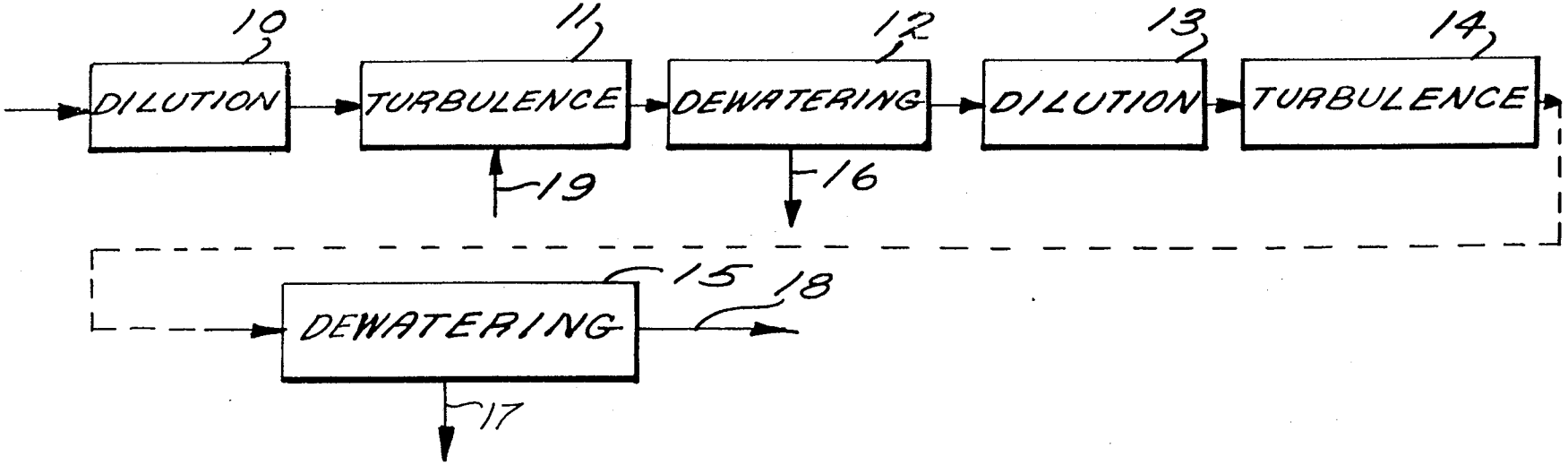
FIG. 1 is a schematic view of exemplary stages utilized in the practice of the deresination method according to the present invention.

FIG. 1 schematically illustrates one exemplary manner of acting upon typical mechanical pulp to effect resin removal in accordance with the present invention. The invention is applicable to all types of mechanical pulps including CTMP, TMP, and CMP.

The pulp from the refiner (typically having a consistency of about 25–45 percent) is fed to dilution stage 10, at which it is diluted to a consistency of about 7–20 percent (preferably about 8–15 percent). Then it is fed at that consistency to the stage 11, wherein it is subjected to high turbulence. At stage 11, the temperature is preferably maintained at about 50°–150° C., and preferably about 70°–120° C. The pulp is subsequently dewatered at stage 12, e.g. to a consistency of about 25 percent, and then subsequently diluted back to a consistency of about 7–20 percent in dilution stage 13. Subsequently the pulp can be subjected to high turbulence in stage 14, and then again to subsequent dewatering in stage 15. During this action, a pressate, which flows in lines 16 and 17 (and at all dewatering stages) is produced, the pressate having a high resin content. The final mechanical pulp 18 is produced; of course any number of sequences of dilution, turbulence-induction, and dewatering stages can be practiced as are necessary to effectively remove the resin from the pulp.

In order to facilitate resin removal from the pulp, it is also desirable to add deresination chemicals to the turbulence stage 11. Typical chemicals for enhancing deresination include pH-adjusting chemicals, or disperging compounds. The addition of such chemicals to the turbulence stage 11 is indicated by reference numeral 19 in FIG. 1.

Typically the mechanical pulp is produced in a refiner, and thus the pulp normally has a temperature of about 100° C. or higher immediately after exiting the refiner. Thus it may not be necessary to add additional heat to the pulp in order to maintain the temperature in the turbulence stage 11 within the desired range. Also the pulp immediately after production in a refiner contains a significant amount of steam, and if the steam is allowed to condense on the pulp, the amount of heat that is necessary to add to the dilution water at stage 10 can minimized.

According to the present invention, it is not necessary to subject the pulp to high turbulence in stages 11, 14, etc. for a very long period of time. Typically the residence time of the pulp in a high turbulence stage would be between about 0.2–60 seconds, preferably 0.2–10 seconds. If it is necessary to increase the amount of time that the pulp is subjected to high turbulence, the system schematically illustrated in FIG. 2 can be utilized.

Figure 2:
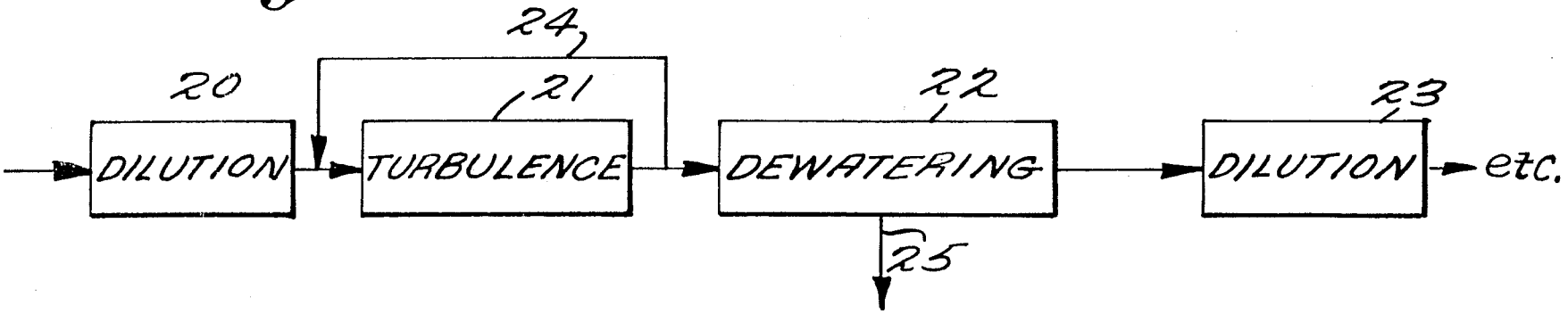
FIG. 2 is a schematic like that of FIG. 1 only showing recirculation of a portion of the treated pulp so that it goes back through the high turbulence stage.

In the system of FIG. 2, pulp is diluted at stage 20 and subjected to turbulence at stage 21, dewatering at stage 22, and dilution at stage 23. Pressate is withdrawn through line 25. In this embodiment, a part (but not all) of the pulp is recirculated from downstream of the turbulence stage 21, through line 24, to a point upstream of the turbulence stage 21. In this way, a part of the pulp is subjected to the high turbulence zone 21 two (or more) times, so a somewhat higher efficiency of resin removal is obtained.

During any of the stages illustrated in FIGS. 1 and 2, the process can be carried out at superatmospheric pressures; the dewatering stages are particularly adapted for superatmospheric conditions.

Figure 3:
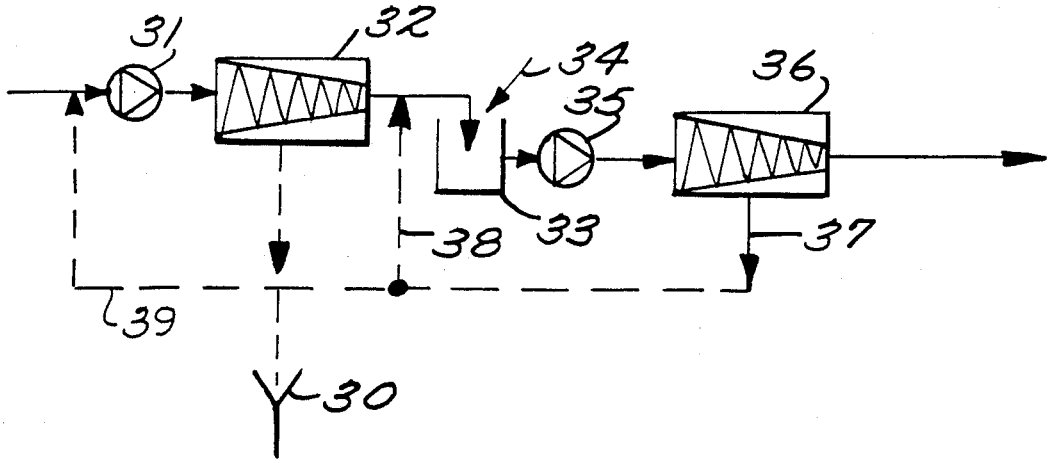
FIG. 3 is a schematic showing of exemplary equipment, such as a pump, screw press, dilution pump, and second screw press, utilizable in the practice of the method of the present invention.

FIG. 3 illustrates in somewhat more detail exemplary apparatus that can be utilized for practicing the method according to the present invention. In this embodiment, the pulp, after dilution to about 7–20 percent consistency, is fed to pump 31. The pump 31 can be a centrifugal pump equipped with a turbulence generator and which is capable of pumping medium consistency pulp. In practice, the pump 31 effects fluidization of the pulp. One exemplary form that the pump 31 may take is shown in U.S. Pat. No. 4,435,193. Additional turbulence generating means may also be added to the inlet of this pump.

The pump 31 pumps the pulp to a screw press 32, from which the pressate is led to a drain line 30. From the press 32 the pulp is led to the pump chute 33, where dilution liquid 34 is added and mixed into the pulp before the pulp is fed to second pump 35, which is of the same type as the pump 31. From pump 35, the pulp is pumped to a second screw press 36. The pressate from line 37 of second screw press 36 has a sufficiently low resin content that it is utilizable as dilution liquid at earlier stages in the sequence, and may be recirculated as indicated by lines 38 and 39 to provide dilution liquid prior to the pumps 31, 35.

In addition to the fluidizing pumps 31, 35, one or more high turbulence mixers may also be utilized in order to provide even higher efficiency. It is particularly useful to add deresination improving chemicals to high turbulence zones provided by mixers.

Figure 4:
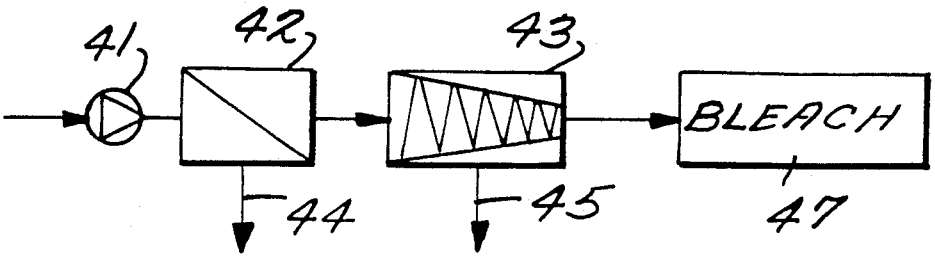
FIG. 4 is a schematic showing of an exemplary two-stage turbulence generator that may be utilized in the practice of the present invention.

In the system of FIG. 4, from fluidizing pump 41 the pulp is pumped to a screen 42, and subsequently to a press 43. The rejects are withdrawn from the pulp at the screen 42 in line 44, while the pressate is withdrawn from press 43 in line 45. The screen 42 must be capable of screening pulp having medium consistency, and is the type of screen that effects fluidization of the pulp before, and partially during, the screening operation. Typical screens are sold by Kamyr, Inc. of Glens Falls, New York and Kamyr AB of Karlstad, Sweden under the trademark "MC".

Figure 8:
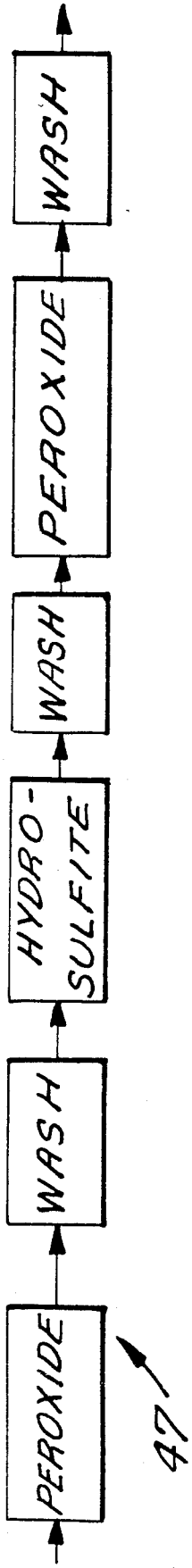
FIG. 8 is a schematic showing of a particular bleaching sequence that may be utilized for acting on the resin-free mechanical pulp produced according to the present invention.

As illustrated in FIG. 4 by the subsequent bleaching stage 47, the mechanical pulp, after resin removal, is preferably subjected to a bleaching action. A typical bleaching sequence is illustrated in FIG. 8. As illustrated in FIG. 8, the bleach stage 47 may actually comprise a peroxide bleach, followed by a wash, followed by a hydrosulfite bleach, followed by another wash, followed by another peroxide bleach, and followed by another wash. Any number of peroxide stages may be provided, preferably with a hydrosulfite stage between or after the peroxide stages, and with a wash after each bleaching stage.

Figure 5:
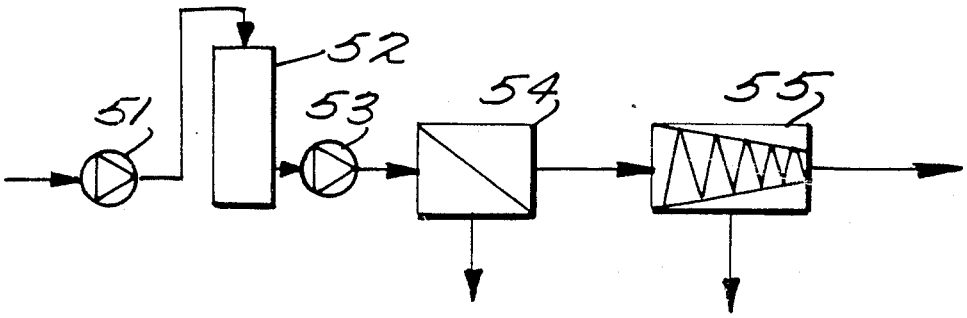
FIG. 5 is a schematic representation of another form of exemplary apparatus for practicing the method of the present invention, wherein storage of the mechanical pulp is practiced between two high turbulence stages.

FIG. 5 illustrates a system similar to that shown in FIG. 4, only utilizing a storage structure between high turbulence stages. In this embodiment the pulp from fluidizing pump 51 passes to storage tower 52, and then subsequently to fluidizing pump 53, screen 54, and press 55. The pulp may be maintained within the tower 52 a desired residence time, and the components downstream from the tower 52 may be operated only as necessary to obtain desired production, while the components upstream of the tower 52 can be operated continuously.

Figure 6:
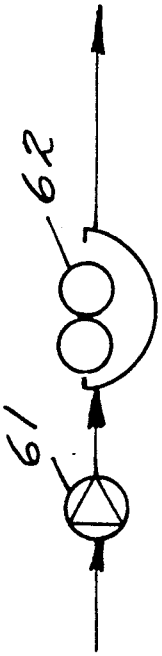
FIG. 6 is a schematic showing of a turbulence inducing pump, followed by a roll press for dewatering, utilizable in the practice of the present invention.

FIG. 6 illustrates another exemplary apparatus for practicing the invention. In this embodiment, pulp from the fluidizing pump 61 is fed to a roll press 62. The roll press 62, and many other different types of conventional presses, may be utilized instead of the screw presses schematically illustrated in the preceding figures.

Figure 7:
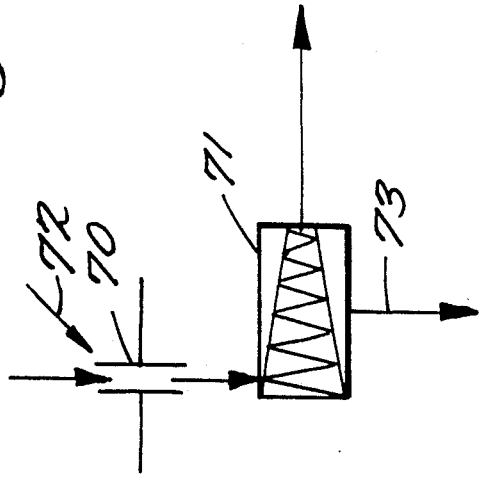
FIG. 7 is a schematic illustration of a refiner which is utilized as a high turbulence component before dilution and dewatering of the pulp.

FIG. 7 shows an embodiment in which the high turbulence stage is provided by a mill, in this case a disc mill type refiner 70. Dilution liquid 72 must be added at the refiner 70 to maintain the pulp at the desired consistency, and after the pulp is subjected to high turbulence by the refiner 70 it is passed to the screw press 71 for subsequent removal of the pressate in line 73.

The invention may also be illustrated by the following example:

EXAMPLE

Laboratory produced chemi-thermo-mechanical pulp was made having a freeness of about 650 ml CSF (Canadian Standard Freeness). The pulp was produced in the laboratory by a laboratory refiner. The pulp was subsequently treated according to the following alternative treatment schemes:

Treatment 1—Conventional-Type Treatment

The pulp was diluted to 5 percent concentration and subjected to slow stirring in a vessel for 30 minutes at 60° C. Thereafter the pulp was pressed by simple compression to a dryness of about 25 percent. The resin quantity of the washed pulp and the pressate was determined according to the DCM-analysis method (DCM=Dichloromethane).

Treatment 2—Laboratory Comparison-Type Treatment

The pulp was diluted to 5 percent at 60° C. and thereafter immediately pressed through compression to about 25 percent dryness. DCM-resin of the washed pulp and the pressage was determined.

Treatment 3—Treatment According to Invention

The pulp was diluted to 10 percent and was fluidized in a fluidizing centrifugal pump for about 2 seconds at a temperature of 60° C. Thereafter the pulp was pressed with compression to about 25 percent dryness. DCM-resin of the pressed pulp and the pressate was determined.

The following table shows the results of the three treatments:

| Treatment | | 1 | 2 | 3 |
|---|---|---|---|---|
| DCM before treatment, | % | 0.67 | 0.67 | 0.67 |
| DCM in pressed pulp, | % | 0.26 | 0.38 | 0.27 |
| DCM in pressate, | g/l | 0.26 | 0.18 | 0.67 |

It is readily apparent from the table that within the measurement deviation the remaining resin in the pulp measured as DCM is the same for treatments 1 and 3, i.e, conventional pretreatment and high turbulence treatment (according to the invention), respectively. Furthermore it is observed that due to the higher inlet concentration during the high turbulence treatment, the concentration of DCM resin in the pressate is more than twice as much as during conventional pretreatment of the pulp. This is perhaps the most important consequence of the present invention: that the pressate from a pressing operation will be considerably more concentrated than is normally the case. Other advantages are lower investment cost and power savings during the handling of liquid flows at high concentration.

Especially with the process system according to FIGS. 4 and 5 one has, in addition to the removal of resin, the ability to perform latency removal. A system for latency removal by means of fluidizing of pulp is described in co-pending U.S. patent application Ser. No. 608,191, filed May 8, 1984.

It will thus be seen that according to the present invention a simple, quick, and effective method has been provided for the removal of resin from mechanical pulp produced from comminuted cellulosic fibrous material. The invention may comprise, or consist of, the described steps. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and procedures.

What is claimed is:

1. A method for removing resin from a mechanical pulp, comprising the steps of:

(a) feeding a mechanical pulp having a consistency of about 7–20 percent to at least one high turbulence stage;

(b) at the high turbulence stage, exposing the mechanical pulp at about 7–20 percent consistency to a high degree of turbulence for a time period of about 0.2–60 seconds; and (c) directly after step (b), dewatering the mechanical pulp to produce a pressate containing resin removed from the pulp.

2. A method as recited in claim 1 comprising the further step (d), after step (c), of diluting the dewatered pulp so that it has a consistency of about 7–20 percent, and then repeating steps (a)–(d) as necessary to effect substantially complete resin removal.

3. A method as recited in claim 1 comprising the further step of, during the practice of step (b), mixing in the pulp deresination-improving chemicals.

4. A method as recited in claim 1 wherein step (b) is practiced by fluidizing the mechanical pulp.

5. A method as recited in claim 4 wherein said fluidizing step is practiced by, and during, centrifugal pumping of the pulp.

6. A method as recited in claim 1 comprising the further step of recirculating a part of the pulp through at least one additional turbulence stage, so that that part of the pulp is subjected to step (b) at least one additional time.

7. A method as recited in claim 1 wherein during practice of step (b), the temperature is within the range of about 50°–150° C.

8. A method as recited in claim 1 comprising the further step (e); after step (c), of bleaching the pulp.

9. A method as recited in claim 8 wherein step (e) is practiced by bleaching the pulp with peroxide.

10. A method as recited in claim 9 wherein step (e) is further practiced by providing at least two peroxide stages, and bleaching the pulp with hydrosulfite after or between the two peroxide stages.

11. A method as recited in claim 10 comprising the further step of washing the pulp between each of the bleaching stages.

12. A method as recited in claim 7 wherein the pulp has a consistency of about 8–15 percent, and wherein the temperature during the practice of step (b) is maintained in the range of about 70°–120° C.

13. A method as recited in claim 2 comprising the further step of, during the practice of step (b), mixing in pulp deresination-improving chemicals; and wherein the method consists of steps (a)–(d).

14. A method as recited in claim 2 wherein the dilution liquid for at least one step (d) is provided by pressate removed from a subsequent step (c).

15. A method as recited in claim 1 wherein step (b) is practiced for a duration of about 0.2–10 seconds, and wherein the pulp has a consistency of about 8–15 percent.

16. A method as recited in claim 1 wherein step (b) is practiced utilizing a disc mill type refiner.

17. A method as recited in claim 1 wherein step (b) is practiced by passing the pulp to a mixer, and adding chemicals to improve deresination at the mixer.

18. A method as recited in claim 1 wherein step (b) is practiced by pumping and then screening the pulp in series.

19. A method as recited in claim 18 comprising the further step of retaining the pulp in a non-turbulent state for a predetermined retention time between the pumping and screening steps.

* * * * *